US005855426A

United States Patent [19]

Burns

[11] Patent Number: 5,855,426

[45] Date of Patent: Jan. 5, 1999

[54] COMBINATION FLASHLIGHT-PYROTECHNIC SIGNALLING DEVICE LAUNCHER

[76] Inventor: Robert Lee Burns, 117 Lake Shore Dr., Pasadena, Md. 21122

[21] Appl. No.: 821,530

[22] Filed: Mar. 21, 1997

[51] Int. Cl.[6] ..... F21V 33/00; F21L 17/00

[52] U.S. Cl. ..... 362/253; 362/110; 362/208; 362/228; 362/234; 102/356

[58] Field of Search ..... 362/110, 113, 362/114, 208, 253, 228, 229, 234; 42/1.15, 103; 102/335, 336, 356, 357

[56] References Cited

U.S. PATENT DOCUMENTS

| | | | |
|---|---|---|---|
| 794,924 | 7/1905 | Cailliez | 362/114 |
| 1,461,600 | 7/1923 | Cottrell | 362/114 |
| 2,625,764 | 1/1953 | O'Brien et al. | 362/102 |
| 3,698,318 | 10/1972 | Shira et al. | 102/343 |
| 4,253,132 | 2/1981 | Cover | 361/232 |
| 5,183,951 | 2/1993 | Bilodeau | 42/1.01 |

*Primary Examiner*—Alan Cariaso
*Attorney, Agent, or Firm*—Max Stul Oppenheimer

[57] ABSTRACT

A novel safety device comprises a flashlight and a pyrotechnic signalling device launcher in a single unit. The device comprises an elongated body comprising two compartments; a first compartment is suitable for carrying batteries for powering the flashlight, while a second compartment is suitable for carrying pyrotechnic signalling means. In a preferred embodiment, the device further comprises a water resistant flashlight switch and a firing mechanism which includes an internal cocking mechanism which is cocked by rotating one segment of the device with respect to a second segment of the device.

12 Claims, 2 Drawing Sheets

COMBINATION FLASHLIGHT-PYROTECHNIC SIGNALLING DEVICE LAUNCHER

FIELD AND BACKGROUND OF THE INVENTION

FIELD OF THE INVENTION

The present invention relates in general to safety devices and in particular to a new and useful device which combines a flashlight and a pyrotechnic signalling device, in a single unit. It also includes a novel firing mechanism particularly suitable for combining said devices in that the cocking element of the firing mechanism is completely internal, thereby allowing the device to be water resistant.

BACKGROUND INFORMATION

A pyrotechnic signalling device generally comprises a sealed tube which contains a material which is to be projected (for example, in the case of a flare launcher, a material which will ignite and burn brightly once it reaches a specified point), a propellant and a primer, closed at one end by a casing designed so as to ignite the primer when struck by a firing pin.

The invention described and claimed herein comprises a novel safety device comprising a flashlight and a pyrotechnic signalling device launcher in a single unit. In a preferred embodiment, the combined device comprises a novel firing mechanism, the cocking element of which is completely internal, thereby allowing the device to be made water resistant. The invention will be described with reference to a preferred embodiment wherein the pyrotechnic signalling device launcher is a flare launcher.

Two valuable safety tools are a flashlight and a flare launcher. For example, Coast Guard regulations require that both devices be carried on certain vessels subject to their jurisdiction. Important elements in designing and stocking an emergency kit are space and portability. Thus, combining two valuable tools such as a flashlight and a flare launcher is desireable.

The same considerations apply to other safety or emergency situations, for example rescue operations. Not only is there a premium on space and portability, but there may be a further premium on the ability of a user to operate multiple devices with one hand, as for example, when the user's other hand is occupied with assisting a rescue victim or maintaining another rescue device such as a rope.

Further, there is a premium on accessability; being able to launch a flare without having to put down a flashlight and search for a flare launcher may reduce response time by life-saving seconds or minutes. Consider the example of a hiker lost at night and traveling by flashlight. Upon hearing a rescue plane, the hiker could fire a location flare within seconds, without needing to put aside the flashlight and look for a flare launcher.

SUMMARY OF THE INVENTION

The foregoing advantages are provided by a device combining a flashlight and pyrotechnic signalling device launcher in a single unit.

The device comprises two compartments: a first compartment suitable for carrying the components of a standard flashlight (i.e, batteries, a light bulb and wiring), and a second compartment suitable for carrying a pyrotechnic signalling device and further comprising firing means for firing the pyrotechnic signalling device. In a preferred embodiment, the device comprises an essentially cylindrical housing carrying the aforementioned compartments and further comprises a water resistant flashlight switch; and the firing means comprises an internal cocking mechanism which is cocked by rotating one segment of the device with respect to a second segment of the device.

It is an object of the invention to provide, in a single unit, a flashlight and a pyrotechnic signalling device launcher.

It is a further object of the invention to provide a single unit which is water resistant.

A principal feature of the invention is the combination of a flashlight and a pyrotechnic signalling device launcher in a single unit.

Another principal feature of the invention is the combination in a single water resistant unit.

Another principal feature of the invention is an internal, water resistant cocking mechanism for the pyrotechnic signalling device launcher.

Among the advantages of the invention are portability, ease of use, water resistance and therefore improved reliability over non-water resistant units.

These and other objects, features and advantages which will be apparent from the discussion which follows are achieved, in accordance with the invention, by providing a novel safety device comprising a flashlight and a pyrotechnic signalling device launcher in a single unit. In a preferred embodiment, the combined device comprises a novel firing mechanism with internal cocking means.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

Figure 1:
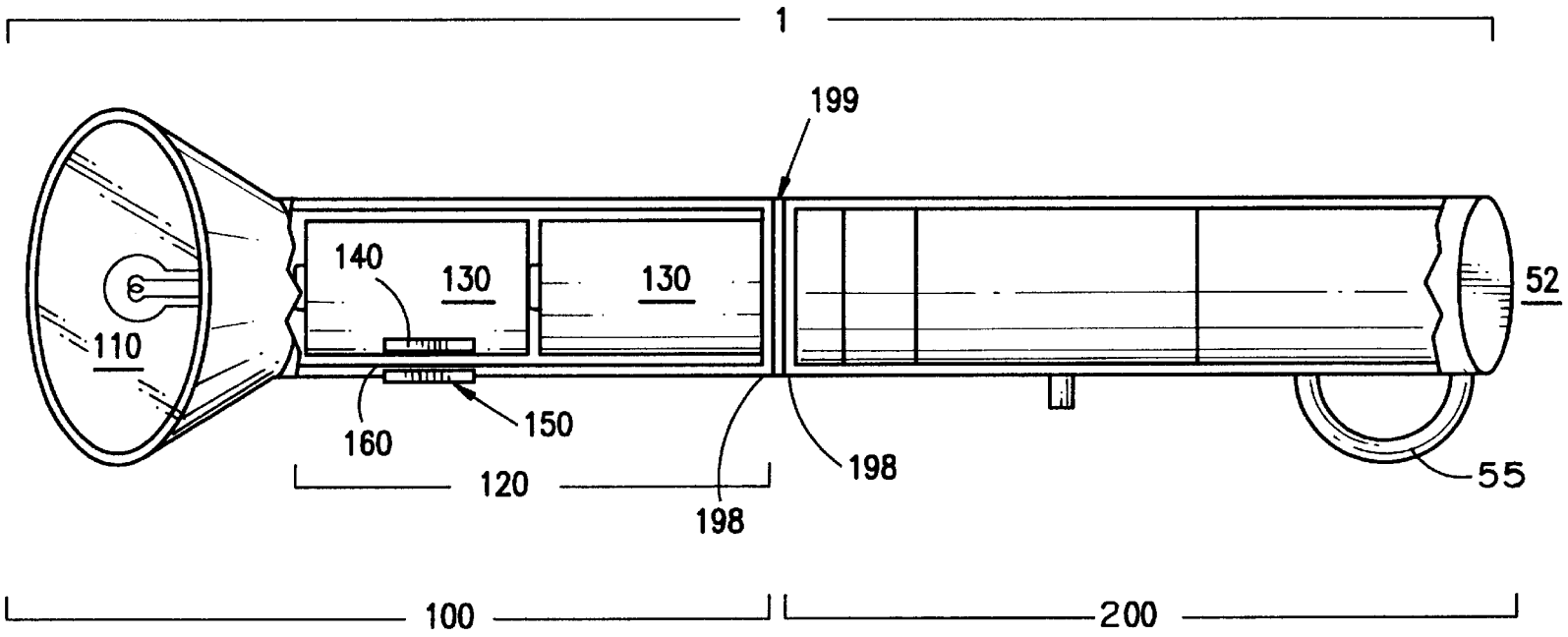
FIG. 1 is a cutaway side view of the device showing its principle components.

Referring to the drawings, the invention is a novel safety device comprising a flashlight and a pyrotechnic signalling device launcher in a single unit. In a preferred embodiment, the combined device comprises a novel, internal cocking and firing mechanism.

Referring to FIG. 1 for an overview, conceptually the device comprises two functional sections within a common housing (1), said common housing preferably being essentially cylindrical.

The first section is a flashlight section (100) comprising a receptacle for a flashlight bulb (110), a battery compartment (120) suitable for holding one or more batteries (130) for powering a flashlight bulb in receptacle (110) and a switch (140) for controlling power from the batteries (130) to the receptacle (110) and thereby to the bulb. In a preferred embodiment, switch (140) is actuated by button (150) which is separated from the switch (140) by a water resistant membrane (160), thereby improving water resistance of the device.

Figure 2:
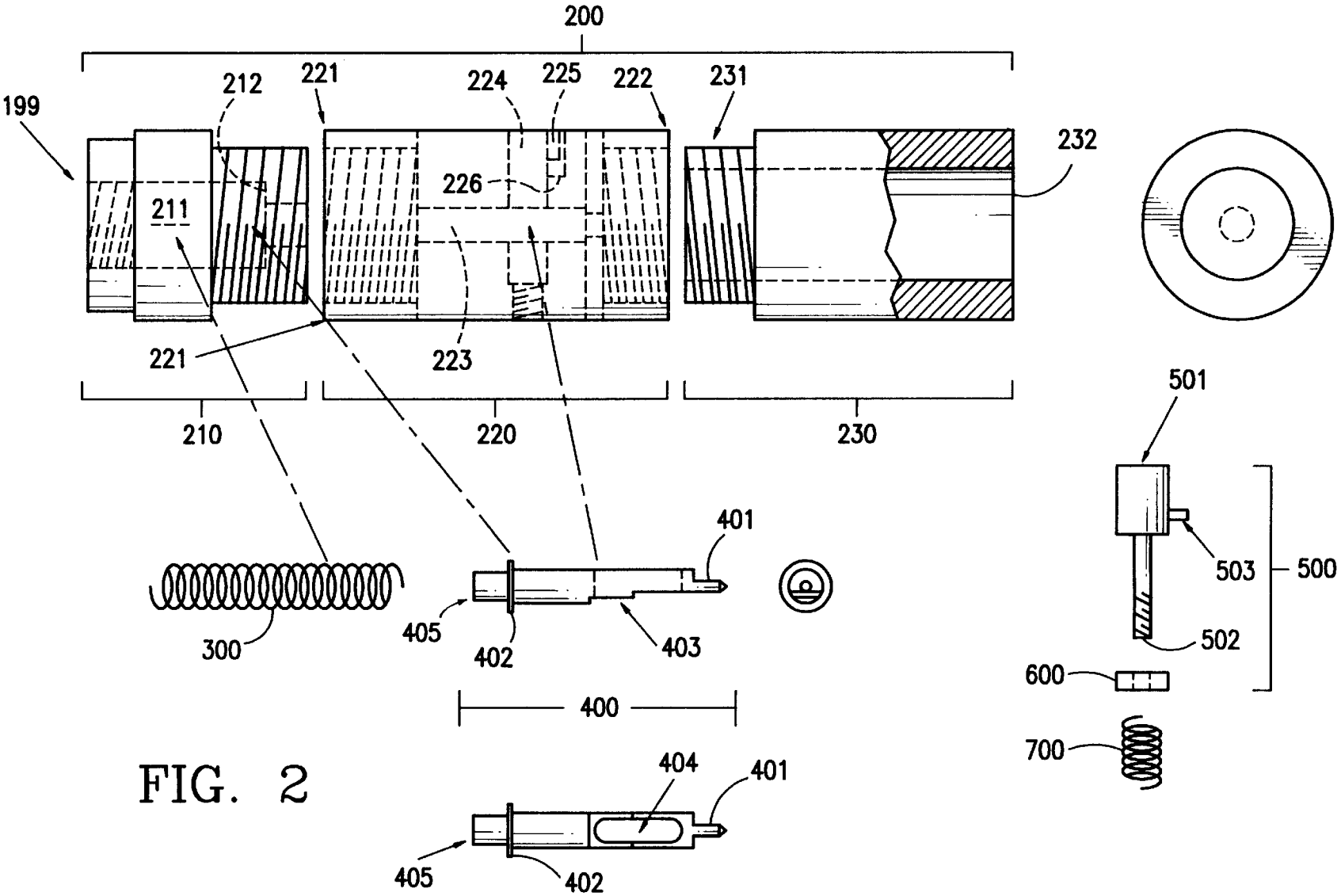
FIG. 2 is a detail view of the components of the novel pyrotechnic signalling device launcher section of the device.

The second section is a pyrotechnic signalling device launcher section (200), defined by the common housing (1) but separated from the flashlight section (100) by a divider (199), said divider preferably being separably coupled to said device launcher section (200) and/or said flashlight section (100) so as to allow access to the battery compartment (120), said second section comprising three releasably coupled segments illustrated in FIG. 2: a cocking segment (210), a firing mechanism (220), and a pyrotechnic signalling device compartment (230) suitable for holding a pyrotechnic signalling device. These three segments are preferably releasably coupled by screw threads Still referring to FIG. 2, cocking segment (210) is preferably a tube, a first end of which is closed by divider (199) and a second end of which is threaded to couple to firing mechanism (220), enclosing a cocking chamber (211) for carrying a firing spring (300). Said cocking chamber (211) is essentially circular in cross-section and stepped when viewed longitudinally. Such a chamber may be constructed by boring a solid cylinder partially through with one size bit, then boring said cylinder completely through with a second size, smaller, bit. Cocking chamber (211) thus has a lip (212) suitable for engaging a firing pin catch (402) (described below)

The firing mechanism (220) comprises a tube, a first end (221) of which is threaded so as to couple to the threaded second end of cocking segment (210) and a second end (222) of which is threaded so as to couple to pyrotechnic signalling device compartment (230), enclosing a firing pin chamber (223) suitable for carrying a firing pin (400) and, at right angles to said firing pin chamber (223) a trigger chamber (224) suitable for carrying a trigger (500), a sear (600) and a trigger spring (700). Preferably, the trigger (500) and trigger chamber (224) are configured so as to act as a safety as well, as described below.

As illustrated in FIG. 2, the firing pin comprises a rod with a stepped flat sear stop (403), terminating at a first end in a striker (401) suitable for detonating a pyrotechnic signalling device upon impact and at a second end in a flat shoulder (405). (Alternatively, a second stepped flat sear stop may be added to limit the forward travel of the striker.) Attached at or near said second end is a firing pin catch (402) of sufficiently small diameter to fit within cocking chamber (211), but of sufficiently large diameter that it cannot pass lip (212). A slot (404) is cut through the firing pin (400) along its long axis and perpindicular to the flat sear stop (403).

The trigger spring (700) is inserted into the trigger chamber (224) from above. The firing pin (400) is then inserted through the cocking chamber (211) and into the firing pin chamber (223) with the striker (401) facing the pyrotechnic signalling device compartment (230), and with the sear stop (403) facing down (away from the trigger). The firing spring (300) is then inserted, bearing on the shoulder (405) of the firing pin (400) and is compressed between the firing pin catch (402) and divider (199) (or alternatively by a plug inserted into the open end of the cocking chamber).

The trigger (500) is then inserted through the firing pin slot (404) and the sear (600) is attached to the trigger (500) below the firing pin slot (404); the sear (600) and lower portion of the trigger (500) are then inserted into trigger chamber (224). So positioned, the sear (600) is pressed up by the trigger spring (700).

The pyrotechnic signalling device compartment (230) comprises a tube, suitable for carrying a pyrotechnic signalling device, a first end (231) of which is threaded so as to couple to the threaded second end (222) of the firing mechanism, and a second end (232) of which permits exit of the pyrotechnic signalling device when launched. Said second end (232) may either be open or covered with a material which is either removable prior to launching or which can be penetrated easily when the pyrotechnic signalling device is launched.

Figure 3:
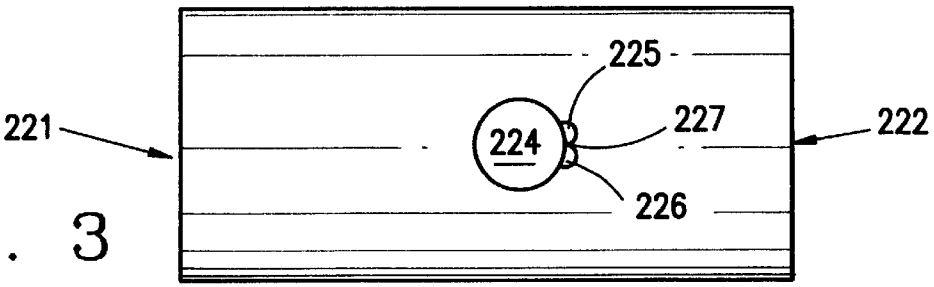
FIG. 3 is a top view of the firing mechanism of the device, showing the details of construction of the safety mechanism of the trigger chamber.

In a preferred embodiment, the trigger (500) is provided with a simple safety device as follows. The trigger (500) comprises an essentially cylindrical rod having a first or user end (501), which is depressed by the user to fire the Pyrotechnic signalling device, a second or sear end (502) which is connected to the sear (600), and a safety pin (503) perpendicular to the axis defined by said first and second ends. The safety pin (503) may be made easily by drilling a hole in the cylindrical rod and inserting a spring-loaded pin. A safety shelf (225) is created in trigger chamber (224) by partially boring a slight enlargement of the trigger chamber. The trigger may then be rotated such that the safety pin (503) rests against the safety shelf (225), thereby preventing the trigger (500) from being depressed sufficiently to release the sear (600), i.e., the "safe" position", or rotated such that the safety pin (503) clears the safety shelf (225), thereby permitting the trigger (500) to be depressed sufficiently to release the sear (600) thereby allowing the firing pin (400) to strike the pyrotechnic signalling device. Referring to FIG. 3, the safety shelf (225) may be created by selecting a suitable size drill bit and drilling a first segment to a first depth so as to create an enlargement of trigger chamber (224), said first depth being insufficient to permit the trigger (500) to be depressed far enough to release the sear (600), then drilling a second segment (226) to a second depth so as to create a second enlargement to trigger chamber (224), overlapping the first segment so as to create a cusp (227), but said second depth being sufficient to permit the trigger (500) to be depressed far enought to release the sear (600). By springloading the safety pin (503), an additional degree of safety is provided since the trigger (500) will "click" into either the "safe" or "fire" position when rotated, and will be held in the selected position by the cusp (227).

Operation of the invention will now be explained. The flashlight section operates as a conventional flashlight. Access to the battery compartment (120) for changing batteries is preferably provided by separable coupling means (198) between the battery compartment (120) and divider (199), for example, standard threading or bayonet mount coupling.

A pyrotechnic signalling device is loaded into the pyrotechnic signalling device launcher section (200) by placing the device in a safe condition (either by releasing tension on the firing spring (300) or by setting the trigger to the "safety" position), uncoupling (in the preferred embodiment, by unscrewing) pyrotechnic signalling device chamber (230), placing a pyrotechnic signalling device in said chamber (230) and recoupling said chamber securely.

The device is cocked by rotating cocking segment (210) with respect to firing mechanism (220) (in the preferred embodiment, by unscrewing), causing lip (212) to pull against firing pin catch (402) until the firing pin (400) is withdrawn sufficiently to be engaged by the sear (600) under pressure from trigger spring (700), thereby placing it in the cocked position. Once cocked, the cocking segment (210) and firing mechanism (220) are returned to their initial, secured, position (in the preferred embodiment, by screwing), thereby improving water resistance. Once cocked, the device should be placed in the "safe", condition as described above.

Prior to firing, second end (232) of the pyrotechnic signalling device chamber must be clear. The device is fired by placing the trigger (500) in the fire position, then depressing the trigger (500), thereby causing the sear (600) to disengage from the firing pin, allowing firing spring (300) to propel firing pin (400) forward so that striker (401) contacts the pyrotechnic signalling device, thereby causing the pyrotechnic signalling device to launch.

Thus, there has been described a novel safety device comprising a flashlight and a pyrotechnic signalling device launcher in a single unit. In a preferred embodiment, the combined device comprises a novel, internal cocking and firing mechanism.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A device comprising a hollow, essentially cylindrical body carrying within said body:

a flashlight at a first end of said cylindrical body; and a pyrotechnic signal device launcher at a second end of said cylindrical body.

2. A device as in claim 1 wherein said flashlight comprises:

an electric light bulb;

a battery compartment for carrying a battery for supplying electricity to said light bulb;

conducting means for conducting electricity to said light bulb; and switch means for controlling the flow of electricity from said battery to said light bulb.

3. A device as in claim 1 wherein said pyrotechnic signal device launcher comprises:

a chamber for carrying a pyrotechnic signalling device, said chamber having a discharge end and a firing pin end opposite said discharge end;

a firing pin mechanism including a firing pin for launching said pyrotechnic signalling device;

a firing spring mechanism having a cocked or spring compressed and a fired, or spring relaxed, said cocked position providing sufficient potential energy that, when released, it is capable of propelling said firing pin against said pyrotechnic signalling device with sufficient force to launch said pyrotechnic signalling device.

4. A device as in claim 1 comprising three releasably coupled segments namely, a cocking segment, a firing mechanism segment, and a pyrotechnic signalling device compartment segment;

said cocking segment having a first end closed by a divider and a second end releasably coupled to said firing mechanism segment, defining the ends of a cocking chamber having a lip at the first end suitable for engaging a firing pin catch;

said firing mechanism segment having a first end which is releasably coupled to said second end of said cocking segment and a second end releasably coupled to said pyrotechnic signalling device compartment, enclosing a firing pin chamber suitable for carrying a firing pin longitudinally within said firing pin chamber, said firing mechanism segment further having at essentially right angles to said firing pin chamber, a trigger chamber suitable for carrying a trigger, a sear and a trigger spring.

5. A device as in claim 4 wherein said firing pin comprises:

a rod with a sear stop, said rod having first and second ends;

said rod having at its first end a striker suitable for detonating a pyrotechnic signalling device upon impact;

said rod having at its second end a shoulder;

said rod containing a longitudinal slot through which a trigger may pass;

said firing pin being carried in the cocking segment.

6. A device as in claim 5, wherein:

a firing pin catch is attached to said rod at or near its second end, said firing pin catch being of sufficiently small diameter to fit within said cocking chamber;

and wherein said cocking chamber further comprises a lip suitable for engaging said firing pin catch and of sufficiently small size to prevent said firing pin catch from passing said lip.

7. A device comprising:

a first section comprising a receptacle for a flashlight bulb, a battery compartment suitable for holding one or more batteries for powering said flashlight bulb and a switch for controlling power from the batteries to the bulb;

a second section releasably coupled to said first section comprising three releasably coupled segments: a cocking segment, a firing mechanism, and a pyrotechnic signalling device compartment;

said cocking segment having a first end and a second end, enclosing between said ends a cocking chamber for carrying a firing spring;

said cocking chamber having a lip for engaging a firing pin catch;

said firing mechanism having first and second ends, said first end releasably coupled to said second end of said cocking segment and said second end being releasably coupled to said pyrotechnic signalling device compartment, enclosing between its two ends a firing pin chamber suitable for carrying a firing pin and, at essentially right angles to said firing pin chamber a trigger chamber suitable for carrying a trigger, a sear and a trigger spring;

said firing pin comprising a rod with a stepped flat sear stop, said rod having first and second ends and terminating at a first end in a striker suitable for detonating a pyrotechnic signalling device upon impact and at a second end in a shoulder;

said firing pin having attached at or near its second end a firing pin catch of sufficiently small diameter to fit within said cocking chamber, but of sufficiently large diameter that it cannot pass said lip;

said firing pin further having a slot along its long axis;

said firing pin being carried in said cocking chamber and said firing pin chamber;

a firing spring bearing on the shoulder of said firing pin so as to propel said firing pin forward when released;

said trigger chamber carrying a trigger spring, a sear under pressure from said trigger spring said sear being connected to a trigger, said trigger passing through said firing pin through said slot so as to disengage said sear from said firing pin when said trigger is depressed;

said pyrotechnic signalling device compartment having a first end releasably coupled to said second end of said firing mechanism and a second end permitting the exit of a pyrotechnic signalling device, defining between said ends a chamber suitable for carrying a pyrotechnic signalling device.

8. A device as in claim 7 wherein said cocking segment is releasably coupled to said firing mechanism by screw threads, thereby allowing said device to be cocked by rotating said cocking segment with respect to said firing mechanism, thereby causing said lip to pull against said firing pin catch until the firing pin is withdrawn sufficiently to be engaged by said sear under pressure from said trigger spring, thereby placing it in the cocked position.

9. A device as in claim 7 further comprising a safety mechanism comprising:

a safety shelf in said trigger chamber, and a safety pin extending from said trigger;

wherein said trigger is rotatable between a first or safe position and a second or fire position, the safety pin engaging the safety shelf in said first position but not in said second position, thereby preventing said trigger from being depressed when in said first position.

10. A device as in claim 9 wherein said safety pin is springloaded.

11. A safety trigger mechanism comprising:

a firing pin chamber suitable for carrying a firing pin and, at essentially right angles to said firing pin chamber a trigger chamber suitable for carrying a trigger, a sear and a trigger spring;

said firing pin comprising a rod with a stepped flat sear stop;

said firing pin further having a slot along its long axis;

said firing pin being carried in said firing pin chamber;

a firing spring bearing on said firing pin so as to propel said firing pin forward when released;

said trigger chamber carrying a trigger spring, a sear under pressure from said trigger spring said sear being connected to a trigger, said trigger passing through said firing pin through said slot, so as to disengage said sear from said firing pin when said trigger is depressed;

said trigger having a spring-loaded safety pin extending therefrom;

said trigger being rotatable between a first or "safe" position and a second or "fire" position;

said trigger chamber having two positions between which said spring-loaded safety pin may be rotated: a "safe" position wherein said spring-loaded safety pin engages a safety shelf, said safety shelf being of a depth insufficient to permit the trigger to be depressed far enough to release the sear; and a "fire" wherein said spring-loaded safety pin bypasses said safety shelf and enters a portion of the trigger chamber having a depth sufficient to permit the trigger to be depressed far enough to release the sear.

12. A safety trigger mechanism as in claim 11, further comprising a cusp between said "safe" position and said "fire" position, said cusp and said spring-loaded safety pin being selected so as to provide resistance to travel between said "safe" position and said "fire" position.

* * * * *